United States Patent [19]

Grigsby

[11] Patent Number: 4,635,815

[45] Date of Patent: Jan. 13, 1987

[54] REINFORCED BULK MATERIAL CONTAINER

[75] Inventor: John M. Grigsby, Marietta, Ga.

[73] Assignee: North American Container Corp., Mableton, Ga.

[21] Appl. No.: 834,899

[22] Filed: Feb. 28, 1986

Related U.S. Application Data

[63] Continuation-in-part of Ser. No. 652,673, Sep. 21, 1984, Pat. No. 4,586,627.

[51] Int. Cl.[4] ..... B65D 5/32; B65D 5/56

[52] U.S. Cl. ..... 220/443; 220/441; 229/23 C; 229/DIG. 4

[58] Field of Search ..... 220/441, 443; 229/DIG. 4, 23 C

[56] References Cited

U.S. PATENT DOCUMENTS

| | | | |
|---|---|---|---|
| 1,987,225 | 1/1935 | Bergstein | 229/DIG. 4 X |
| 2,277,674 | 3/1942 | Belsinger | 229/23 C |
| 2,693,894 | 11/1954 | Elmendorf | 229/23 C X |
| 2,910,221 | 10/1959 | Whiton | 220/441 X |
| 2,949,151 | 8/1960 | Goldstein | 229/DIG. 4 X |
| 3,159,326 | 12/1964 | Stonebanks | 229/23 C X |
| 3,643,856 | 2/1972 | Jones | 220/441 |
| 3,648,920 | 3/1972 | Stump | 220/441 X |
| 3,910,482 | 10/1975 | Bamburg et al. | 220/443 X |
| 4,087,041 | 5/1978 | Centanni | 220/441 |
| 4,177,935 | 12/1979 | Centanni | 220/443 X |
| 4,260,442 | 4/1981 | Ford et al. | 229/DIG. 4 X |
| 4,586,627 | 5/1986 | Grigsby | 220/443 |

FOREIGN PATENT DOCUMENTS

| | | | |
|---|---|---|---|
| 538727 | 6/1955 | Belgium | 220/441 |

*Primary Examiner*—Steven M. Pollard
*Attorney, Agent, or Firm*—Jones & Askew

[57] ABSTRACT

A reinforced container for bulk pack materials wherein a first blank of paperboard is bonded to a second blank of paperboard. A plurality of support members are fixedly secured between the first blank and second blank of paperboard so as to reinforce the container. The support members are preferably formed of wood and positioned near the corners of the container.

3 Claims, 10 Drawing Figures

REINFORCED BULK MATERIAL CONTAINER

CROSS-REFERENCE TO RELATED APPLICATION

This application is a continuation-in-part of Ser. No. 652,673, filed Sept. 21, 1984, now U.S. Pat. No. 4,586,627.

TECHNICAL FIELD

The present invention relates to containers formed from corrugated paperboard and more particularly, relates to a reinforced container for shipping and storing bulk materials.

BACKGROUND OF THE INVENTION

Containers made of corrugated paperboard have long been used for shipping and storing a variety of bulk materials such as powders, tobacco, metal castings, plastic resins, peanuts and many other materials. Such bulk materials are typically poured or thrown into the container and shipped loose so that the packed materials "flow" about the interior of the container.

Since the total weight of a single loaded container may run as high as fifteen hundred (1500) pounds, the packing and shipping of bulk materials presents several unique problems. One problem is that the side walls of the container must be sufficiently rigid in the horizontal plane to withstand internal movement of the load. Stated in the parlance of the trade, the side walls must resist against bulging as a result of internal material flow. Another problem is that the side walls of the container must also be sufficiently rigid to permit stacking of one container on top of another. Stated in the parlance of the trade, the side walls must provide sufficient compression strength to prevent any deformation or collapse of the container when others are stacked upon it.

While various prior art containers have been developed in an attempt to solve these problems, the problems persist. For example, in an effort to increase both bulge resistance and compression strength, U.S. Pat. No. 3,910,482 to Bamburg et al. discloses a laminated container having an outer box with an intermediate liner and an inner liner, each layer being formed of corrugated paperboard. Yet because all paper absorbs moisture, a container manufactured according to Bamburg (as well as any other multi-layered containers) loses its rigidity when placed or kept in a humid environment for any significant period of time. Because a warehouse typically provides just such an environment, these containers often deform and collapse. As a result, the containers are destroyed and the contents stored therein damaged or contaminated.

Multi-layered containers are conventionally manufactured with corrugated paperboard having vertically aligned corrugations. The purpose of this vertical alignment is two-fold. First, vertical alignment of the corrugations makes it easier to fold the container about a vertical line and thus form the corners. Second, vertical alignment of the corrugations increases the compression or stacking strength of the container. However, there are problems with using paperboard having vertically aligned corrugations. The primary problem is that this alignment or the corrugations renders the side walls more likely to crease or take a "false score". A related problem is that a container formed with vertically aligned corrugated paperboard is more likely to experience side wall bulge.

Yet another prior art attempt to improve both stacking strength and bulge resistance has been to insert posts into the corners of the container. These posts are often formed of laminated paperboard, wood or some like rigid material. While corner posts are recognized to improve stacking strength in unit load containers (containers for appliances, machinery, etc.), they are ineffective when used in a bulk material container for many reasons. One reason is that the bulk material is often surrounded in the container by a bag or sack made of polyurethane. As the bulk material flows within the container, the posts are dislodged and will tear the polyurethane bag. In addition, because the bulk material will settle into the corners of the container while being packed, the very insertion of any corner post can tear the polyurethane bag. Yet further, movement of the bulk material upon shipment of the container can break or splinter a corner post. Once the bag is torn, the posts can and often do contaminate the bulk materials stored therein.

Yet other problems exist when corner posts are used. The posts, by their very presence, decrease the usable volume of space within the container. Because the corner posts are placed directly in the corner, it is not possible to collapse or "knock down" containers with corner posts. It is desirable, and in light of the costs associated with shipping containers from the manufacturer to an end user, necessary that a bulk material container be knocked down for delivery to a customer. When inserted posts are used, they must be shipped separately of the container so that the container can be knocked down for shipping. Thus, the corner posts cannot be pre-attached to the container by the manufacturer. As a result, an additional unnecessary set-up cost is incurred by the end user. Furthermore, an additional cost is recognized in the shipment and maintenance of an additional inventory of posts separate and apart from the containers themselves. All of these factors work to increase the cost of the end product in terms of labor, handling, materials and time. These factors further work to increase the cost of purchasing the containers as the customer must coordinate the purchasing, storing and matching of containers and corner posts.

Thus, the prior art has heretofore lacked a bulk material container having sufficient side wall rigidity in both the horizontal and vertical planes to provide a container with the desired bulge resistance and compression strength. The prior art has further lacked a one-piece integral container of such side wall rigidity that could be knocked down flat for shipment by the manufacturer and easily set up by the end user.

SUMMARY OF THE INVENTION

The present invention solves the above-described problems in the prior art by providing a reinforced bulk container that combines supporting members with laminated corrugated paperboard to achieve the desired bulge resistance and compression strength. In addition, the present invention provides a one-piece integral container unit that can be knocked down for shipment and easily set up without unnecessary labor, handling and expenditure of time.

Generally described, a reinforced bulk material container according to the present invention includes an outer wall forming blank of paperboard and an inner wall forming blank of paperboard. A plurality of support members are fixedly retained between the outer wall forming blank and the inner wall forming blank. As disclosed in a second embodiment, a filler pad may be provided between the support members and the first wall forming blank and the second wall forming blank. As disclosed in a third embodiment, support members may be provided on one or more of the top flanges of the container. As such, the present invention provides a unitary container wherein the side walls are reinforced so as to increase compression strength and to prevent against any bulging thereof.

Described more particularly, a first preferred embodiment of the present invention is disclosed. This first embodiment comprises an outer wall forming blank of paperboard scored to provide a series of wall panels foldably joined together and a second wall forming blank of paperboard also scored to provide a series of wall panels foldably joined together. The second wall forming blank is formed for bonding to the inside surface of the first wall forming blank. A plurality of support members are fixedly retained between the first wall forming blank and the second wall forming blank, with at least one support member being provided on each wall of the container.

A second preferred embodiment of the present invention is disclosed. This second embodiment comprises a first wall forming blank of vertically corrugated paperboard scored to provide a series of wall panels foldably joined together and a second wall forming blank of vertically corrugated paperboard also scored to provide a series of wall panels foldably joined together. The second wall forming blank is formed for binding to the inside surface of the first wall forming blank. A plurality of support members are fixedly retained between the first wall forming blank and the second wall forming blank, with at least two support members being provided on each wall panel. A plurality of sheet-like members are secured between both the first wall forming blank and the second wall forming blank and the support members fixedly retained therebetween. Each sheet-like member preferably comprises a blank of horizontally corrugated paperboard.

A third preferred embodiment of the present invention is disclosed. This third embodiment further includes a plurality of top flanges foldably joined to the upper edge portion of the wall panels of the first wall forming blank. At least one support member is laminated or otherwise bonded to the bottom of at least one of the top flanges.

Thus, it is an object of the present invention to provide an improved bulk material container.

It is a further object of the present invention to provide a bulk material container reinforced with support members that increase stacking strength and bulge resistance.

It is a further object of the present invention to provide a reinforced bulk material container that reduces the potential for increasing or false scoring of the container walls.

It is a further object of the present invention to provide a reinforced bulk material container that maintains its side wall rigidity both in the horizontal and vertical planes under conditions of high heat and humidity.

It is a further object of the present invention to provide an integral, one-piece bulk material container reinforced with support members in such a manner as that the container can be knocked down for shipment and easily set up for filling.

It is a further object of the present invention to provide a reinforced bulk material container that does not decrease the volume of usable space within the container.

It is a further object of the present invention to provide a bulk material container that is reinforced with support members in such a manner as to prevent contamination of the products stored therein.

It is a further object of the present invention to provide a horizontally corrugated wall panel so as to resist against any bulging or false scoring of the container side wall.

These and other objects, features and advantages of the present invention will become apparent from a reading of the following specification in conjunction with the accompanying drawings.

DETAILED DESCRIPTION

Figure 1:
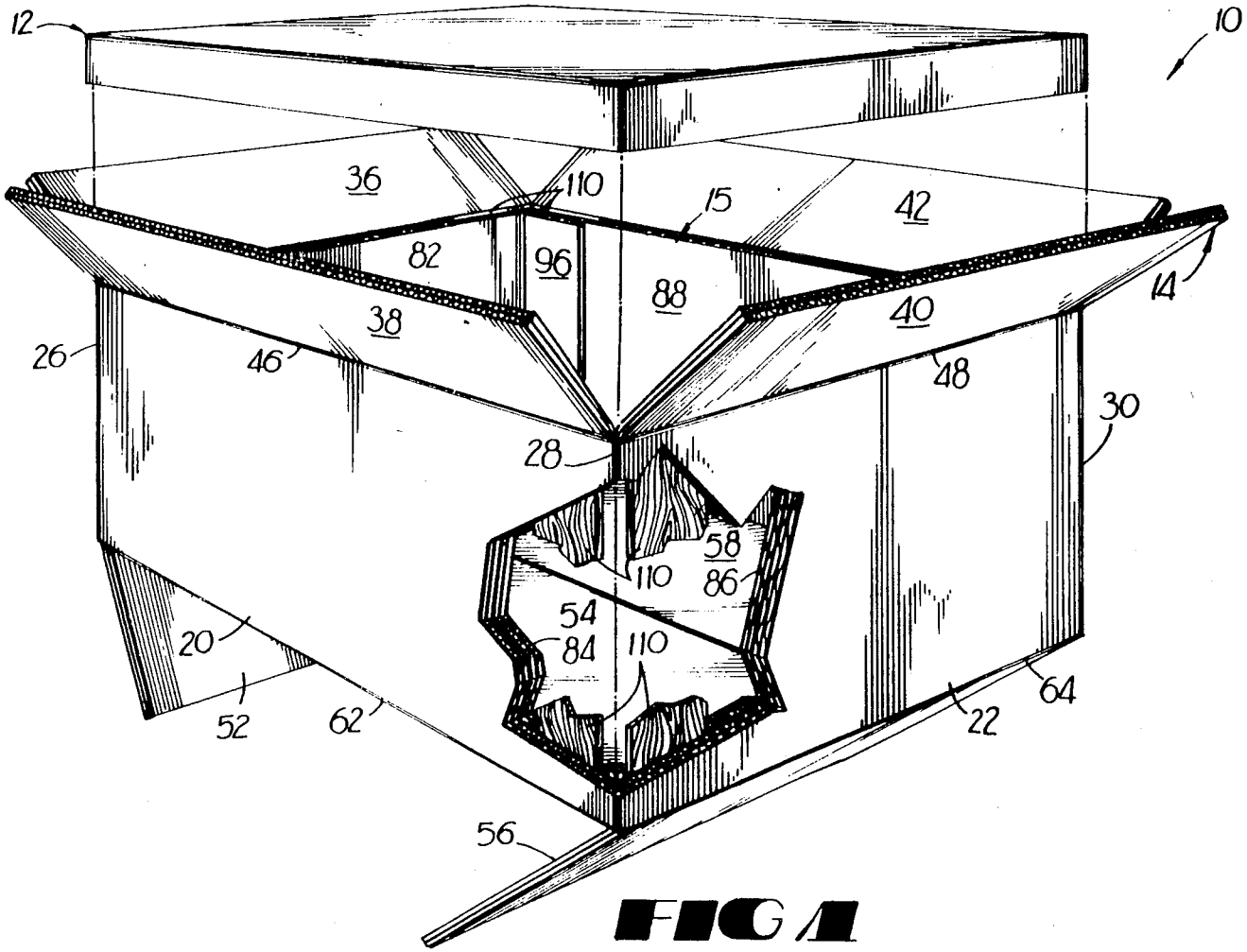
FIG. 1 is a pictorial view of a first preferred embodiment of a reinforced bulk material container according to the present invention, with a portion of the container being cut away to show the support members.

Referring now in more detail to the drawing, in which like numerals indicate like parts throughout the several views, FIG. 1 shows generally at 10 a first preferred embodiment of the present invention. FIG. 1 further shows a cap member 12 positioned immediately above the container 10. The cap member 12 may be formed of any suitable material and is provided for closing off the top of the container 10. Thus, the cap member 12 is dimensioned so as to fit snugly over the top of the container 10. The details of the cap member 12 are outside the scope of the present invention and thus, it is not disclosed further herein.

Those skilled in the art will recognize that FIG. 1 shows no bottom support member such as a pallet or a slip sheet under the bottom of the container 10. Of course, various bottom support members could be provided including, but not limited to, pallets, slip sheets and bottom caps. Such bottom support members are well known in the art, and hence, need not be disclosed further herein. Thus, it is to be understood that the present invention has applications exclusive of conventional corrugated paperboard containers. For example, the present invention may take the form of a tube-like container consisting of only side walls with no top or bottom flaps or flanges.

Figure 2:
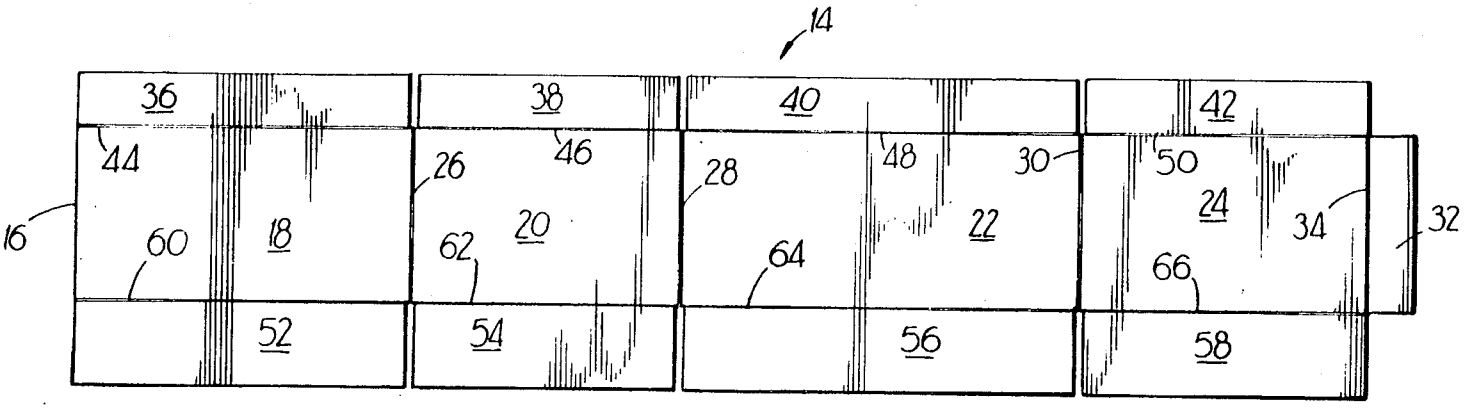
FIG. 2 is a plan view of a paperboard blank for forming the outer shell of the container shown in FIG. 1.

The first preferred embodiment of the present invention is formed with an outer shell 14 and an inner liner 15. FIG. 2 shows a typical blank 16 of sheet-like material suitable for forming the outer shell 14. The preferred sheet-like material is corrugated paperboard. The outer shell blank 16 includes four main panels 18, 20, 22 and 24 foldably connected along three score lines 26, 28 and 30. The four main panels 18, 20, 22 and 24 form the four outer side walls of the container 10 as shown in FIG. 1. A manufacturer's joint flap 32 is foldably connected to the main panel 24 along a score line 34. The function of the outer shell joint flap 32 is described in greater detail hereinbelow. Those skilled in the art will appreciate that the outer shell 14 may be modified so that manufacturer's joint flap 32 is positioned within the container 10 instead of lapped over the outside. Such an arrangement is also well-known in the art. A series of four top flaps 36, 38, 40 and 42 are foldably connected to the main panels 18, 20, 22 and 24, respectively, along respective score lines 44, 46, 48 and 50. Similarly, a series of four bottom flaps 52, 54, 56 and 58 are foldably connected to the main panels 18, 20, 22 and 24 along respective score lines 60, 62, 64 and 66.

Figure 5:
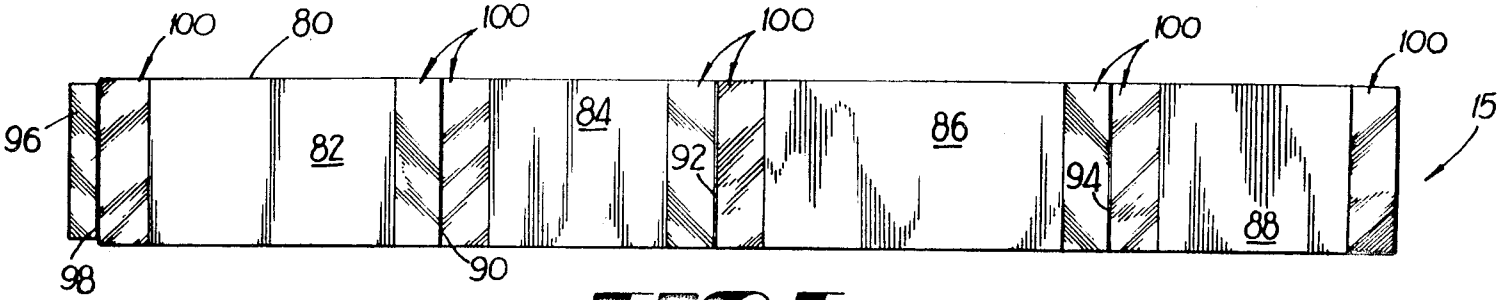
FIG. 5 is a plan view of the paperboard blank shown in FIG. 3, showing the crushed portions of the blank.

FIG. 5 shows a typical blank 80 of sheet-like material suitable for forming the inner liner 15. While other materials may be used, the preferred sheet-like material is corrugated paperboard. The inner liner blank 80 includes four main panels 82, 84, 86 and 88 from the four innermost side walls of the container 10 when the inner liner 15 is bonded to the outer shell 16 as described below. The inner liner blank 80 provides a joint flap 96 foldably connected to the main panel 82 along a score line 98. The left end portion and the right end portion of each main panel 82, 84, 86 and 88, as well as the joint flap 96, are crushed or otherwise deformed to facilitate bonding of the inner liner 15 to the outer shell 16. These crushed areas of the main panels 82, 84, 86 and 88 are indicated generally at 100. The crushed areas are shown in FIG. 5 by diagonal shading lines.

Figure 3:
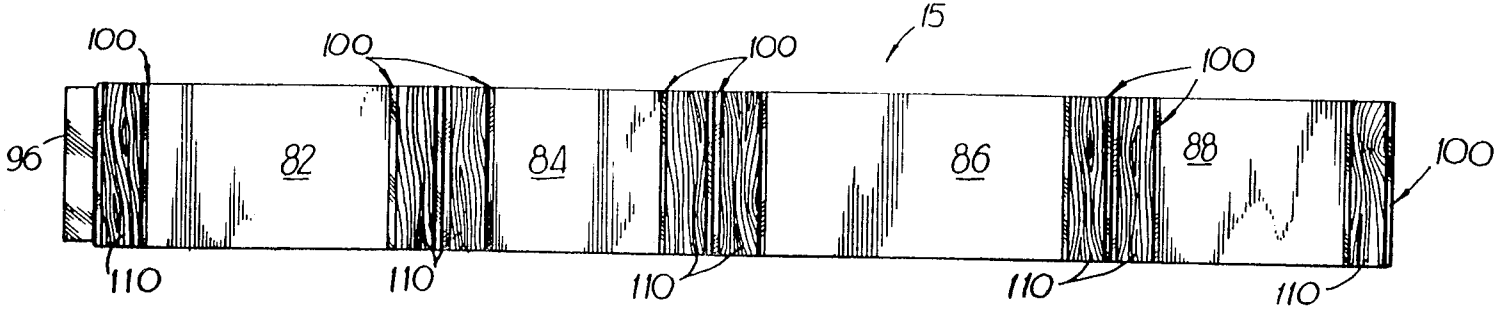
FIG. 3 is a plan view of a paperboard blank for forming the depth liner or inner wall portion of the container shown in FIG. 1, showing the reinforcing members bonded to the depth liner.

A plurality of reinforcing or support members 100 are bonded to the backside of the inner liner 15. The backside of the inner liner 15 (shown best in FIG. 3 and FIG. 5) is that side of the inner liner that is to be engaged to the outer shell 14. The support members 110 may be formed of any suitably rigid material. A particularly preferred material is a wood veneer, typically ranging in thickness from $\frac{1}{8}''$ to $\frac{1}{2}''$ and in width from $2\frac{3}{4}''$ to $3\frac{3}{4}''$. The length of the support member 110 depends upon the height of the container 10. Preferably, the length of the support member 110 is substantially equal to the height of the depth liner 15, which is, in turn, substantially equal to the interior or inside height of the container 10.

A support member 110 is secured to the left and right end portion of each main panel 82, 84, 86 or 88 of the inner blank 80. This bonding may be done using any suitable adhesive. The support members 110 are aligned and secured vertically so to provide the maximum supporting effect when the container is erected. For reasons described in greater detail hereinbelow, the support members 110 are positioned within the crushed areas 100 of the main panels 82, 84, 86 and 88 of the depth liner blank 80. Upon erection of the container 10, this results in the support members 110 being located near the corners of the container. The support members 110 are preferably bonded as close to the corners as possible, but not so close as to prevent the container from being folded down into a substantially flat position. Additionally, in order to further increase container rigidity and compression strength, a support member 110 may be bonded near the center or otherwise intermediate of the outer ends of the main panels 82, 84, 86 or 88.

Figure 6:
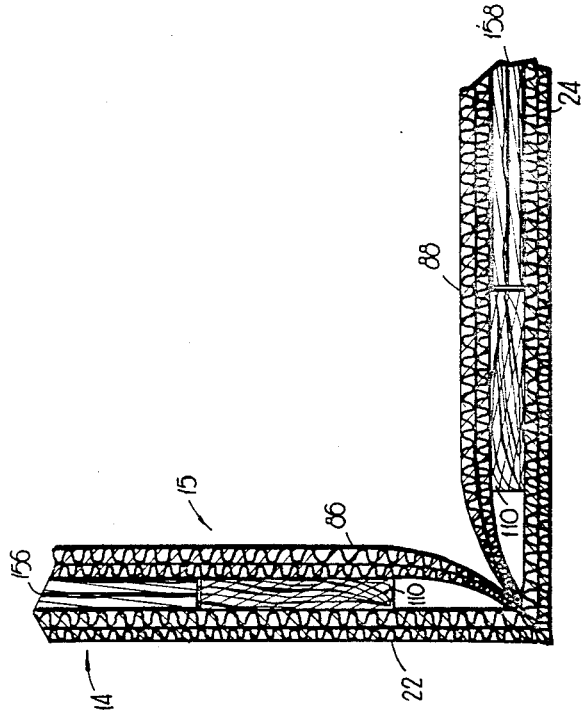
FIG. 6 is a partial cross-section view of a second preferred embodiment of a reinforced bulk material container according to the present invention.

FIG. 6 shows the corner of a second preferred embodiment of the present invention and, thereby, shows construction of the same. A container constructed in accordance with the second embodiment provides the outer shell 14 and the inner liner 15. The outer shell 14 and the inner liner 15 are constructed from typical blanks of paperboard 16 and 80 as described above. FIG. 6 shows in particular the corner of that container formed by panels 22 and 24 of the outer shell 14 and the panels 86 and 88 of the depth liner 15. In accordance with the present invention, support members 110 are provided between the outer shell 14 and the inner liner 15. One support member 110 is laminated or otherwise fixedly retained between the panels 22 and 86. The other support member 110 is similarly retained between the panels 24 and 88.

Figure 7:
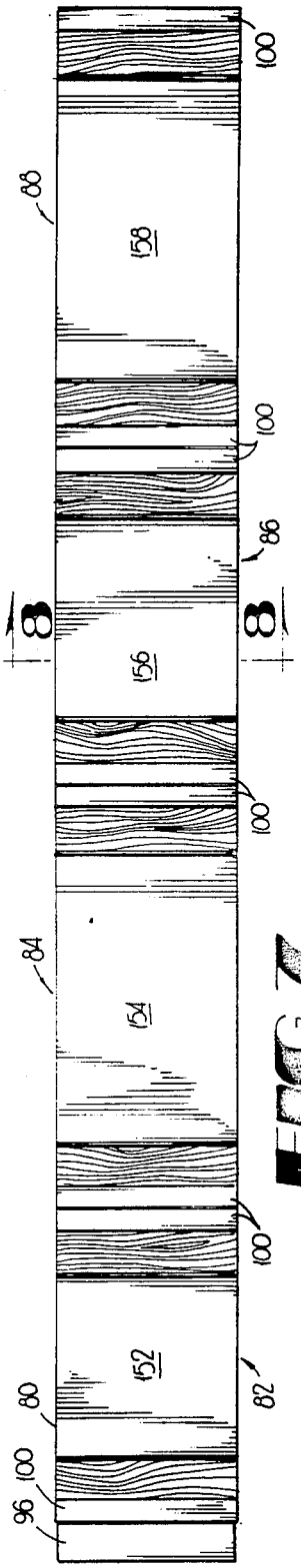
FIG. 7 is a plan view of the interior wall portions of a container constructed according to the second preferred embodiment of the present invention.

The second embodiment of the present invention further includes four filler pads 152, 154, 156 and 158 secured between the inner liner 15 and the outer shell 14. FIG. 7 shows an inner liner 15 constructed with filler pads 152, 154, 156 and 158 in accordance with the second preferred embodiment of the present invention. The liner 15 of this second embodiment defines the four main panels 82, 84, 86 and 88 and the joint flap 96 foldably connected to the left-most panel 82. In a manner identical to that shown in FIG. 3, each panel 82, 84, 86 and 88 provides two crushed areas 100 for receipt of the support members 110. FIG. 7 further shows four filler pads 152, 154, 156 and 158 secured to the panels 82, 84, 86 and 88, respectively. Thus, it is to be understood that the filler pads 152, 154, 156 and 158 are retained between the support members 110 so as to provide a substantially level surface therebetween. It is to be further understood that the support pads 152, 154, 156 and 158 are retained between the inner liner 15 and the outer shell 14. As shown best in FIG. 6, filler pad 154 is fixedly retained between panel 24 and 88. Filler pad 156 is retained between panel 22 and 86. The filler pads 152, 154, 156 and 158 may be secured in such positions by bonding, lamination or any other suitable method.

Figure 8:
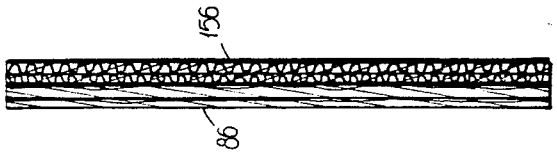
FIG. 8 is a cross-section view of the interior wall portions in FIG. 7 taken along line 8—8.

The filler pads 152, 154, 156 and 158 are preferably formed of corrugated paperboard and extend the full height of the depth liner 15. Furthermore, the inner liner panels 82, 84, 86 and 88 and the outer wall panels 18, 20, 22 and 24 may be conventionally formed of paperboard having substantially vertical corrugations. However, the filler pads 152, 154, 156 and 158 (as best shown in FIGS. 6 and 8) are preferably made of paperboard having substantially horizontal corrugations. Of course, the inner panels 82, 84, 86 and 88 and the outer panels 18, 20, 22 and 24 may be formed of paperboard with horizontal corrugations and the filler pads 152, 154, 156 and 158 formed of paperboard with vertical corrugations.

Figure 9:
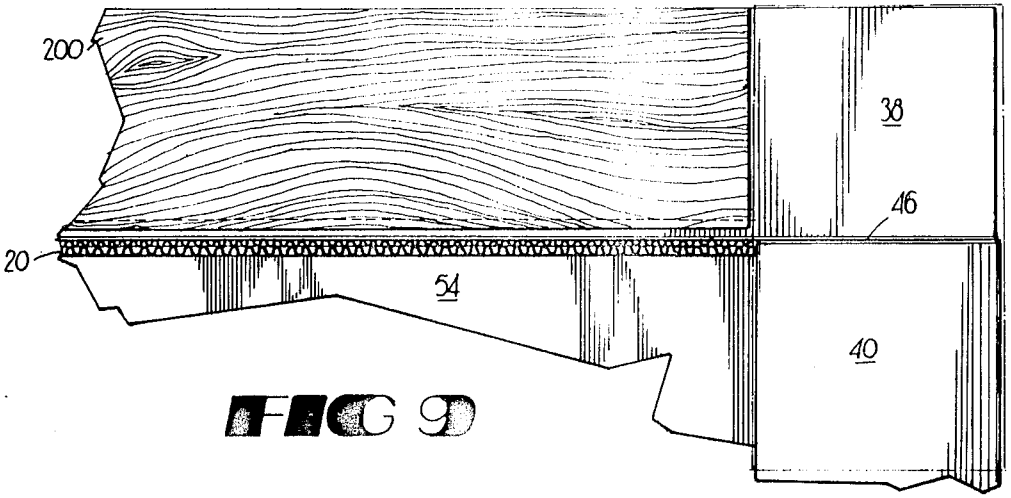
FIG. 9 is a top view of the corner of a container constructed according to the third preferred embodiment of the present invention.
Figure 10:
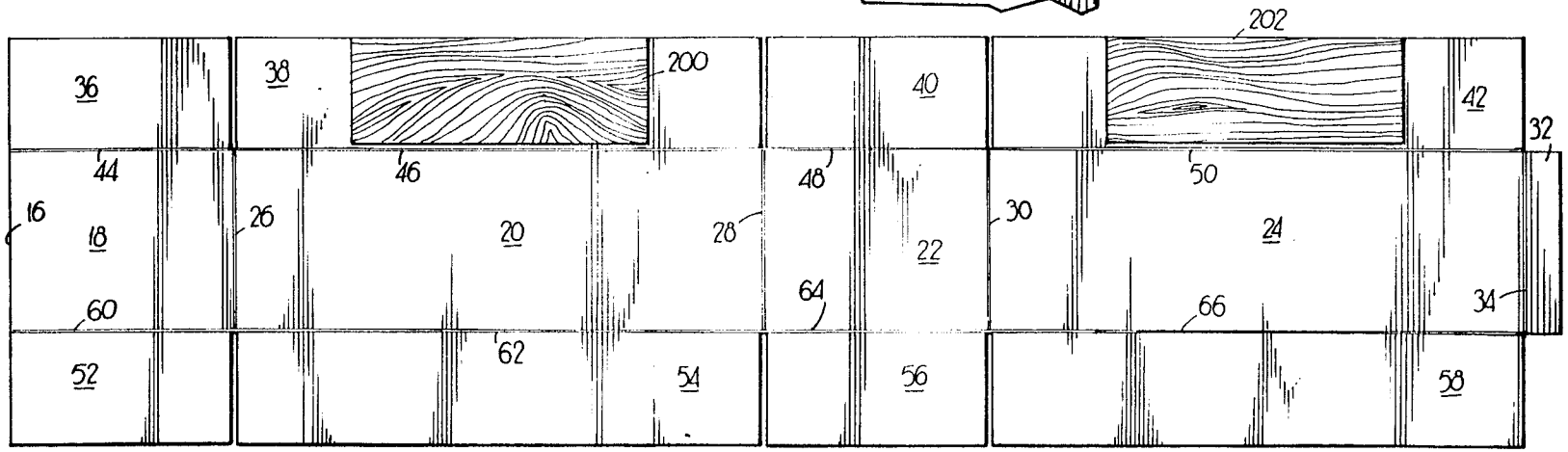
FIG. 10 is a plan view of an outer blank of a container constructed in accordance with the third preferred embodiment of the present invention.

A third preferred embodiment of the present invention is shown in FIGS. 9 and 10. It is to be understood that this third embodiment includes an outer shell 14, a depth liner 15 and support members 110 as described hereinabove in the first two disclosed embodiments. However, this third embodiment further includes a modification of the outer shell 14 as described below.

As shown in FIG. 10, the outer shell 14 of the third embodiment is formed of the single blank of paperboard 16. The blank 16 defines the four main panels 18, 20, 22 and 24 foldably joined together along score lines 26, 28 and 30, respectively. A joint flap 32 is foldably attached to the panel 32 along a score line 34. The series of four top flaps 36, 38, 40 and 42 are foldably joined to the main panels 18, 20, 22 and 24, respectively, along respective score lines 44, 46, 48 and 50. Similarly, the series of four bottom flaps 52, 54, 56 and 58 are foldably joined to the main panels 18, 20, 22 and 24, respectively, along respective score lines 60, 62, 64 and 66. Those skilled in the art will recognize that the top flaps 36, 38, 40 and 42 and the bottom flaps 52, 54, 56 and 58 are conventionally folded inward at right angles to prevent against any buckling of the side walls. Should any top flap 36, 38, 40 or 42 crease or take a "false score" during filling of the container or storage of the container, the flap may pull free and thereby allow the side wall buckle.

The third disclosed embodiment provides two support members 200 and 202 bonded or otherwise secured to the inside of the top flaps 38 and 42, respectively. FIG. 9 shows a partial view of a container constructed according to this third embodiment. Flap 38 is open, thereby revealing the support member 200 fixedly retained to the inside thereof. Flap 40 is closed. It is to be noted that the support member 200 has been positioned so that it will not contact flap 40 when closed. Furthermore, because flap 38 closes over flap 40, the support member 200 gravitationally depresses both flaps. The result of this arrangement, as described in greater detail below, is to insure that the top flaps 36, 38, 40 and 42 remain in a closed position and do not pull free. Even so, those skilled in the art will appreciate that corrugated paperboard often displays a resiliency about a fold or score. Thus, the top flaps 38 and 40 may "spring back" into an open position. These flaps 38 and 40 may therefore be retained in a closed position by any conventional method including tape, staples or alternately overlapping and tucking the flaps into a fixed position.

The present invention is manufactured in accordance with the following method. The outer shell blank 16 and the inner liner blank 80 initially appear as shown in FIG. 2 and FIG. 5, respectively. The outer shell blank 16 may be formed of a single wall or double wall corrugated paperboard or any other suitable material. Similarly, the inner liner blank 80 may be formed of a single wall or double wall corrugated paperboard, or any other suitable material. As shown in the drawings, the double wall paperboard is particularly well suited for practice of the present invention. The wood veneer support members 110 are then bonded to the depth liner of the paperboard blank 80. More particularly, with reference to the first disclosed embodiment of the present invention, the back side (or inside) of each main panel 82, 84, 86 and 88 of the depth liner blank 80 is provided with a wood veneer support member 110 at its left and right edge portion. As described above, the support members are preferably maintained a distance away from a corner portion of the container so as to provide for the containers being knocked down prior to shipment.

As also noted above, portions of the inner liner paperboard blank 80 may be crushed for receipt of the support members 110. Those skilled in the art will appreciate that the dimensions of the wood veneer support 110 (as well as the density of the paperboard) may be varied to provide a desired container strength. Those skilled in the art will further appreciate that additional support members 110 may be added intermediate those shown at the left and right edge portions of the main panels 82, 84, 86 and 88 if the particular application of the present invention requires such.

Figure 4:
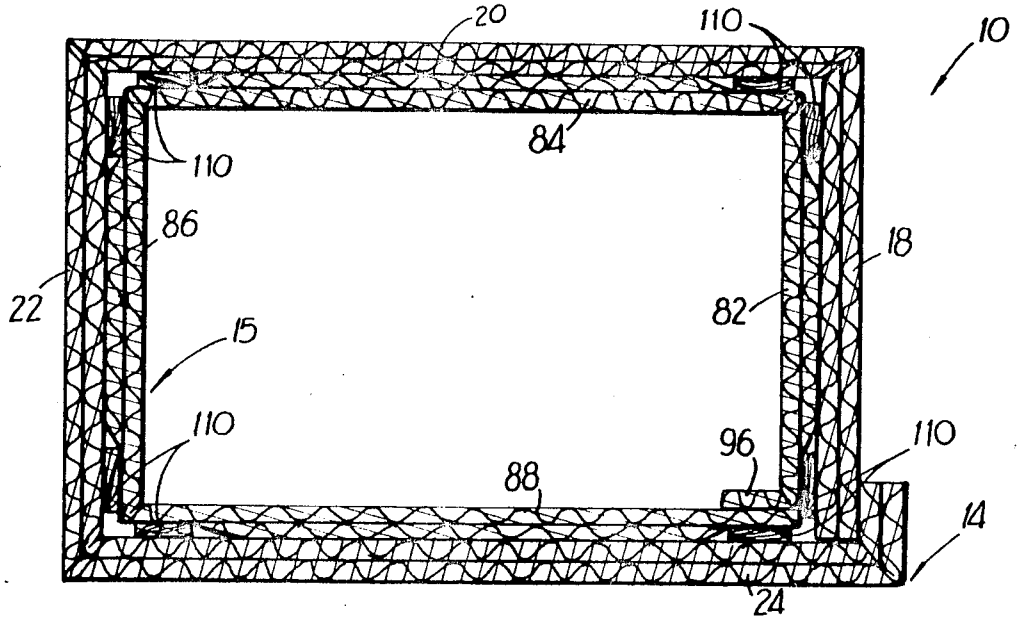
FIG. 4 is a horizontal cross-section view of the container shown in FIG. 1.

Once the wood support members are glued or otherwise bonded to the backside of the depth liner 15, the blank may be bonded to the outer shell 16 in the conventional manner. A preferred method is to extrude or roll an adhesive material either onto the outer shell 14 or the inner liner 15, and then pass either the adhesive treated blanks 16 or 80 through a compression device, thereby bonding same. Because the crushed portions of the inner liner 15 overlap the support members 110, the inside surface of the container 10 is smooth and free of any indentation that could result from the support members. This bonding operation results in a container 10 as shown in FIG. 1 and FIG. 4.

The second disclosed embodiment is constructed in the following manner. The filler pads 152, 154, 156 and 158 are laminated or otherwise bonded to the back side of the main panels 82, 84, 86 and 88, respectively, of the inner liner 15 between the support members 110. The depth liner 15, with the filler pads 152, 154, 156 and 158 in place, is in laminated or otherwise bonded to the outer shell so that the support members 100 and the filler pads 152, 154, 156 and 158 are retained therebetween.

The third disclosed embodiment is constructed in the following manner. The wood support members 200 and 202 are laminated or otherwise bonded to the top flaps 38 and 42. Preferably, the top flaps 38 and 42 rest on top of the other two top flaps 36 and 40, respectively. However, all of the top flaps may be provided with wood support members if desired. The flaps 36, 38, 40 and 42 are then closed over the top of the container in the conventional manner. The result is to gravitationally depress all of the flaps so as to prevent any one from pulling free; thereby further preventing against any buckling of a side wall.

Thus, the present invention provides an improved bulk material container. The support members 110 provide the container with an increased side wall rigidity that improves both stacking strength and bulge resistance. Because the support members 110 are preferably made of a wood veneer material, they resist water absorption and the container maintains such increased stacking strength and bulge resistance even under hot and humid conditions. Furthermore, the retention of the wood veneer support members 110 between the outer shell 14 and the inner liner 15 in combination with the crushed portion 100 of the inner liner causes no loss of internal container volume. The placement of the support members 110 between the outer shell 14 and the inner liner 15 eliminates the need for any manual insertion of the support members. This insures that the products stored within the container 10 is not disturbed or damaged by such insertion of a support member. This arrangement prevents against any tearing of a polyurethane bag and, in fact, prevents against any contact of the support members with the product stored within the container.

Furthermore, the present invention provides a bulk material container that, through use of fillerpads having horizontal corrugations, substantially decreases any potential for false scoring or other creasing of a side wall. The present invention also provides top flap support members 200 and 202 that insure that the top flanges 36, 38, 40 and 42 remain perpendicular to the side walls and do not pop free therefrom. This arrangement insures against any buckling of the side walls as a result of top flap explosion.

Thus, the present invention substantially reduces any potential for container failure through the use of support members and corrugated paperboard to increase side wall rigidity in both the horizontal and the vertical plane. The present invention furthermore provides a one-piece, integral unit that can be knocked down flat for shipment to an end user and easily and quickly set up by an end user.

This specification has described the preferred embodiments of the present invention, including the steps necessary for fabricating the preferred embodiments disclosed. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

I claim:

1. A reinforced bulk material container comprising:

a first wall-forming blank scored to provide a series of main panels foldably joined together, said first wall-forming blank being formed of corrugated paperboard having corrugations in a first alignment and defining an inside surface and an outside surface;

a second wall-forming blank scored to provide a series of main panels foldably joined together, said second wall-forming bland being formed of corrugated paperboard having corrugations in said first alignment and defining a front side surface and a back side surface;

a pair of independent support members secured to said back side surface of said second wall-forming blank at the location of each said score, said pair of support members each extending substantially the height of said second wall-forming blank and arranged so as to straddle and be spaced apart from said score;

a filler bonded to each main panel of said second wall-forming blank, said filler being formed of corrugated paperboard having corrugations in an alignment substantially perpendicular to that of said first alignment and dimensioned so as to extend substantially the width of said main panel between said support members secured thereto and substantially the height of said second wall forming blank;

said backside surface of said second wall-forming blank being laminated to said inside surface of said first wall forming blank so as to provide a unitary container having a series of reinforced side walls foldably joined together;

whereby the interior of said container defined by said front side surface of said second wall-forming blank of paperboard provides a plurality of continuous, protrusion-free inner surfaces foldably joined together at corners such that said container may be collapsed into a flat condition for shipping and easily erected for filling.

2. A reinforced bulk material container comprising:

a first wall-forming blank scored to provide a series of main panels foldably joined together, said first wall-forming blank being formed of corrugated paperboard having corrugations in a first alignment and defining an inside surface and an outside surface;

a second wall-forming blank scored to provide a series of main panels foldably joined together, said second wall-forming blank being formed of corrugated paperboard having corrugations in said first alignment and defining a front side surface and a back side surface;

a pair of independent support members secured to said back side surface of said second wall-forming blank at the location of each said score, said pair of support members each extending substantially the height of said second wall-forming blank and arranged so as to straddle and be spaced apart from said score;

said backside surface of said second wall-forming blank being crushed at the location of each of said support members to accommodate the thickness of the support member and thus provide a continuous surface suitable for laminating to said first wall-forming blank;

a filler pad bonded to each main panel of said second wall-forming blank, each said filler pad being formed of corrugated paperboard having corrugations in an alignment substantially perpendicular to that of said first alignment and dimensioned so as to extend substantially the width of said main panel between said support members secured thereto and substantially the height of said second wall forming blank;

said backside surface of said second wall-forming blank including said filler pads bonded thereto, being laminated to said inside surface of said first wall forming blank so as to provide a unitary container having a series of reinforced side walls foldably joined together;

whereby the interior of said container defined by said front side surface of said second wall-forming blank of paperboard provides a plurality of continuous, protrusion-free inner surfaces foldably joined together at angular corners so that said container may be collapsed into a flat condition for shipping and easily erected for filling.

3. The reinforced bulk material container of claim 2 wherein said first alignment of corrugations is substantially vertical when said container is erected.

* * * * *